US009129567B2

(12) United States Patent
Jeon et al.

(10) Patent No.: US 9,129,567 B2
(45) Date of Patent: Sep. 8, 2015

(54) LIQUID CRYSTAL DISPLAY AND METHOD OF DISPLAYING IMAGE THEREON UTILIZING STORED LOOK-UP TABLES TO MODIFY AN INPUT IMAGE SIGNAL

(75) Inventors: Jae-Gwan Jeon, Incheon (KR); Jae Hyoung Park, Suwon-si (KR); Byung Kil Jeon, Asan-si (KR); Byoung Seok Yoo, Incheon (KR); Bong-Ju Jun, Cheonan-si (KR)

(73) Assignee: Samsung Display Co., Ltd., Yongin (KR)

( * ) Notice: Subject to any disclaimer, the term of this patent is extended or adjusted under 35 U.S.C. 154(b) by 452 days.

(21) Appl. No.: 13/435,446

(22) Filed: Mar. 30, 2012

(65) Prior Publication Data

US 2013/0120233 A1 May 16, 2013

(30) Foreign Application Priority Data

Nov. 15, 2011 (KR) ..... 10-2011-0119027

(51) Int. Cl.
*G09G 3/36* (2006.01)

(52) U.S. Cl.
CPC ..... *G09G 3/36* (2013.01); *G09G 2320/041* (2013.01); *G09G 2340/16* (2013.01)

(58) Field of Classification Search
CPC .... G09G 2320/041–2320/048; G09G 2340/16
USPC ..... 345/87–104, 211–213
See application file for complete search history.

(56) References Cited

U.S. PATENT DOCUMENTS

| | | | | |
|---|---|---|---|---|
| 7,642,999 | B2 | 1/2010 | Oura | |
| 7,688,304 | B2 | 3/2010 | Park | |
| 7,791,583 | B2 | 9/2010 | Lin et al. | |
| 7,804,470 | B2 | 9/2010 | Poon | |
| 7,821,488 | B2 | 10/2010 | Shen et al. | |
| 2004/0201564 | A1 * | 10/2004 | Sugino et al. | 345/101 |
| 2006/0050038 | A1 | 3/2006 | Cheon et al. | |
| 2006/0103682 | A1 * | 5/2006 | Kunimori et al. | 345/690 |
| 2006/0158415 | A1 * | 7/2006 | Izumi | 345/98 |
| 2007/0182694 | A1 * | 8/2007 | Lee et al. | 345/101 |
| 2008/0111828 | A1 | 5/2008 | Ahn et al. | |
| 2008/0136767 | A1 * | 6/2008 | Kim et al. | 345/101 |
| 2011/0096105 | A1 | 4/2011 | Park et al. | |

FOREIGN PATENT DOCUMENTS

| | | |
|---|---|---|
| JP | 2003-186019 | 7/2003 |
| JP | 2006-047691 | 2/2006 |

(Continued)

*Primary Examiner* — Sanghyuk Park
(74) *Attorney, Agent, or Firm* — H.C. Park & Associates, PLC

(57) ABSTRACT

A liquid crystal display includes a pixel, a memory configured to store a plurality of look-up tables, an image signal modification unit configured to obtain a modified look-up table based on a first look-up table and a second look-up table among the plurality of look-up tables and modify an input image signal based on the modified look-up table to generate a modified image signal, and a data driver configured to convert the modified image signal generated by the image signal modification unit into a data voltage and to supply the data voltage to the pixel. The liquid crystal display includes a plurality of regions. The liquid crystal display is configured to maintain temperature information of the plurality of regions, and the image signal modification unit is configured to modify the input image signal based on the temperature information.

18 Claims, 9 Drawing Sheets

(56) References Cited

FOREIGN PATENT DOCUMENTS

| | | |
|---|---|---|
| JP | 2008-039868 | 2/2008 |
| JP | 4367947 | 9/2009 |
| JP | 4637686 | 12/2010 |
| KR | 10-0525496 | 10/2005 |
| KR | 10-0797750 | 1/2008 |
| KR | 1020110124390 | 11/2011 |

* cited by examiner

LIQUID CRYSTAL DISPLAY AND METHOD OF DISPLAYING IMAGE THEREON UTILIZING STORED LOOK-UP TABLES TO MODIFY AN INPUT IMAGE SIGNAL

CROSS-REFERENCE TO RELATED APPLICATION

This application claims priority from and the benefit of Korean Patent Application No. 10-2011-0119027, filed on Nov. 15, 2011, which is incorporated herein by reference for all purposes as if fully set forth herein.

BACKGROUND OF THE INVENTION

1. Field of the Invention

Exemplary embodiments of the present invention relate to a liquid crystal display and a method of displaying an image on a liquid crystal display.

2. Discussion of the Background

A liquid crystal display is one of the more common types of flat panel displays currently in use. A liquid crystal display typically includes two sheets of display panels with field-generating electrodes (such as a pixel electrode and a common electrode, etc.) formed thereon, and a liquid crystal layer interposed therebetween. The liquid crystal display generates electric fields in a liquid crystal layer by applying voltages to the field generating electrodes, and determines the direction of liquid crystal molecules of the liquid crystal layer by the generated electric field, thus controlling polarization of incident light so as to display images.

Depending on a position of a heat source such as an image board, a power board, and a control board, a temperature difference spatially occurs in the liquid crystal display, and the variation in temperature across the display device may cause variation in response speed in liquid crystal display device.

The above information disclosed in this Background section is only for enhancement of understanding of the background of the invention and therefore it may contain information that does not form the prior art that is already known in this country to a person of ordinary skill in the art.

SUMMARY OF THE INVENTION

Additional features of the invention will be set forth in the description which follows, and in part will be apparent from the description, or may be learned by practice of the invention.

An exemplary embodiment of the present invention provides a liquid crystal display, including: a pixel, a memory configured to store a plurality of look-up tables, an image signal modification unit configured to obtain a modified look-up table based on a first look-up table and a second look-up table among the plurality of look-up tables and modify an input image signal based on the modified look-up table to generate a modified image signal, and a data driver configured to convert the modified image signal generated by the image signal modification unit into a data voltage and to supply the data voltage to the pixel. The liquid crystal display includes a plurality of regions. The liquid crystal display is configured to maintain temperature information of the plurality of regions, and the image signal modification unit is configured to modify the input image signal based on the temperature information.

Another exemplary embodiment of the present invention provides a method of displaying an image on a liquid crystal display, the liquid crystal display including a plurality of regions, the method including: storing a plurality of look-up tables, obtaining a modified look-up table based on a first look-up table and a second look-up table among the plurality of look-up tables, modifying an input image signal based on the modified look-up table and temperature information of at least some regions of the liquid crystal display to generate a modified image signal, and converting the modified image signal into a data voltage and supplying the data voltage to a pixel of the liquid crystal display.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
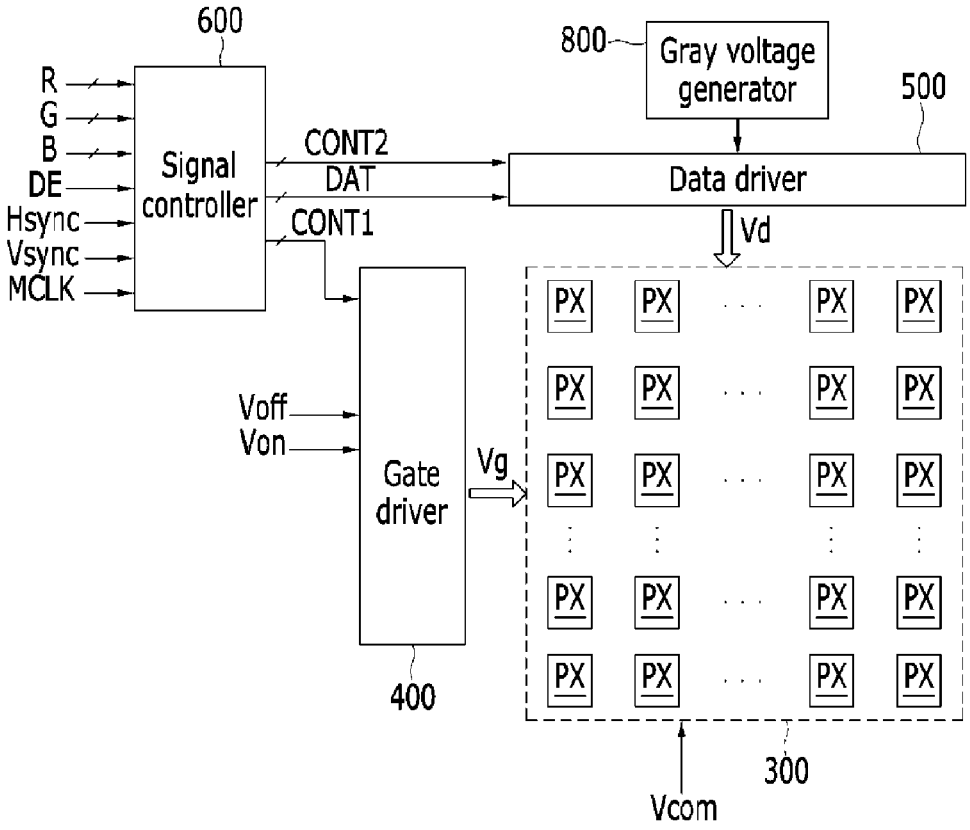
FIG. 1 is a schematic diagram illustrating a liquid crystal display according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification. Further, detailed description of widely known prior art will be omitted.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

FIG. 1 is a schematic diagram illustrating a liquid crystal display according to an exemplary embodiment of the present invention.

Referring to FIG. 1, a liquid crystal panel assembly 300 includes a plurality of pixels PX that are arranged in a substantially matrix shape. The plurality of pixels PX are connected to a plurality of signal lines respectively. The signal lines include a plurality of gate lines that transmit gate signals ("scanning signals") and date lines that transmit data signals.

A gray voltage generator 800 generates two groups of gray voltages (or groups of reference gray voltages) that are related to transmittance of the pixels. One of the two groups has positive values with respect to a common voltage Vcom and the other has negative values.

A gate driver 400 is connected to the gate lines of the liquid crystal panel assembly 300 and applies gate signals each consisting of a combination of gate-on voltage Von and gate-off voltage Voff to the gate lines.

A data driver 500 is connected to the data lines of the liquid crystal panel assembly 300 and selects a gray voltage from a gray voltage generator 800, thereby applying the gray voltage to the pixels as the data voltage. However, when the gray voltage generator 800 does not provide voltages for all gray scales, but provides only a certain number of reference gray voltages, the data driver 500 divides the reference gray voltages to generate gray voltages for all gray scales and select a data signal among the gray voltages.

A signal controller 600 controls the gate driver 400 and the data driver 500.

Each of the above-mentioned drivers 400, 500, 600, and 800 may be mounted directly on the liquid crystal panel assembly or on a flexible printed circuit film (not shown) as at least one IC chip to be attached to the liquid crystal panel assembly 300 as a TCP (tape carrier package). Alternatively, the above drivers 400, 500, 600, and 800 may be integrated in the liquid crystal panel assembly 300 together with the signal lines and thin film transistor switching elements Q. Further, all these drivers 400, 500, 600, and 800 may be integrated in a single chip. In this case, at least one of these drivers or at least one circuit component that forms the drivers may be disposed outside the single chip.

A signal controller 600 receives input image signals R, G, and B from an external graphic controller (not shown) and input control signals that are used to control display of the input image signals. The input image signals R, G, and B contain luminance information of each pixel, and the luminance information has the predetermined number, for example, 1024 (=210), 256 (=28) or 64 (=26) of gray scales. Examples of the input control signals include a vertical synchronization signal Vsync, a horizontal synchronization signal Hsync, a main clock MCLK, and a data enable signal DE.

The signal controller 600 appropriately processes the input image signals R, G, and B in accordance with an operating condition of the liquid crystal panel assembly 300 and the data driver 500 based on the input image signals R, G, and B and the input control signals. After generating gate control signals CONT1, data control signals CONT2, a backlight control signal, and the like, the signal controller 600 outputs the gate control signals CONT1 to the gate driver 400 and outputs the data control signals CONT2 and the processed image signals DAT to the data driver 500. The output image signals DAT are digital signals and have a predetermined number of values (or level of gray scales).

The gate control signals CONT1 include a scanning start signal STV that instructs to start scanning and at least one clock signal that controls an output period of the gate-on voltage Von. The gate control signals CONT1 may further include an output enable signal OE that restricts duration of the gate-on voltage Von.

The data control signals CONT2 include a horizontal synchronization start signal STH that notifies the transmission start of image data for pixels in a row, and a load signal LOAD and a data clock signal HCLK that applies the data signal to the data lines (D1-Dm). The data control signals CONT2 may further include an inversion signal RVS that inverses the voltage polarity of the data signal with respect to the common voltage Vcom (hereinafter, "voltage polarity of a data signal with respect to the common voltage" is referred to as "polarity of a data signal").

In response to data control signals CONT2 from the signal controller 600, the data driver 500 receives digital image signals DAT for pixels PX in one row, and selects a gray voltage corresponding to each of the digital image signals DAT to convert the respective digital image signal DAT into an analog data signal, and then apply the analog data signal to a corresponding data line (D1-Dm). The number of gray voltages generated by the gray voltage generator 800 is equal to the number of gray scales represented by the respective digital image signal DAT.

The gate driver 400 applies the gate-on voltage Von to the gate lines G1-Gn in response to the gate control signals CONT1 from the signal controller 600 to turn on a switching element Q that is connected to the gate lines G1-Gn. By doing so, the data signal applied to the data lines D1-Dm is applied to the corresponding pixel PX through the turned-on switching element Q.

The difference between the voltage of the data signal applied to the pixel PX and the common voltage Vcom generates a charged voltage of a liquid crystal capacitor (CLC), in other words, a pixel voltage. The arrangement of liquid crystal molecules varies depending on the amplitude of pixel voltage, and thus the polarization of light passing through a liquid crystal layer is changed. The change in polarization is shown as the change in light transmittance by a polarizer attached in the liquid crystal panel assembly 300, so that the pixel PX indicates the luminance represented by a gray scale of the respective image signals DAT.

The above process is repeated using one horizontal period ("1H", which is the same as the one period of the horizontal synchronization signal Hsync and the data enable signal DE) as a unit, so that data signals are applied to the plurality of pixels PX by sequentially applying the gate-on voltage Von to a plurality of gate lines, thereby displaying an image of one frame.

After completing one frame, display of next frame starts. The status of an inversion signal RVS applied to the data driver 500 is controlled so that the polarity of the data signal that is applied to the respective pixels PX is opposite to the polarity of the previous frame ("frame inversion"). In this case, even in one frame, in accordance with the characteristics of the inversion signal RVS, the polarity of the data signal that flows through one data line may be changed (for example, row inversion, dot inversion) or the polarities of data signals that are applied to one pixel row may be different from each other (for example, column inversion, dot inversion).

Figure 2:
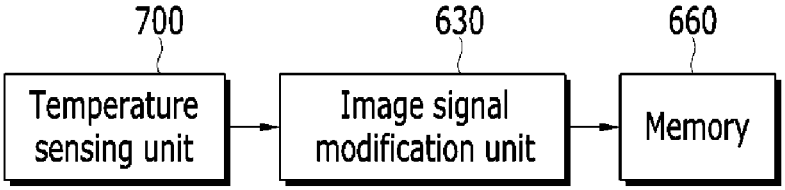
FIG. 2 is a schematic diagram illustrating a liquid crystal display according to an exemplary embodiment of the present invention.
Figure 3:
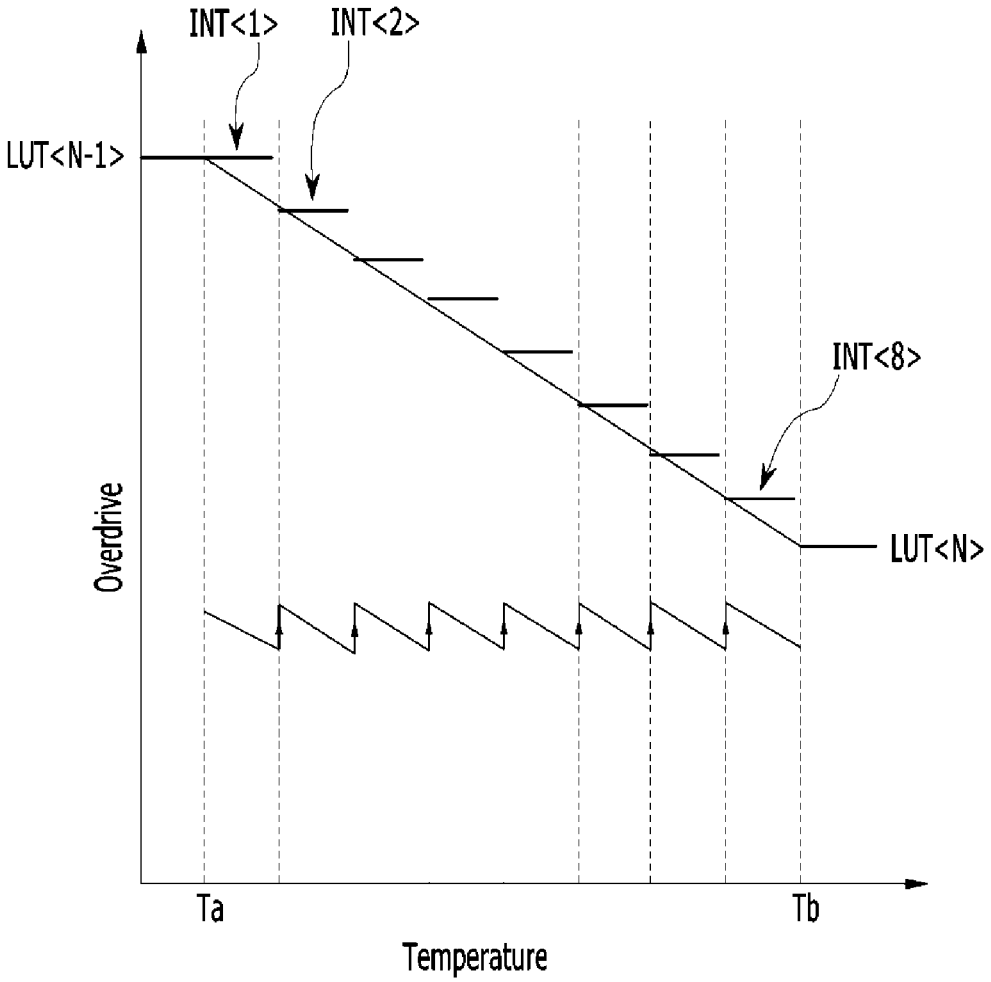
FIG. 3 is a graph showing a response characteristic of liquid crystal of a liquid crystal display according to an exemplary embodiment of the present invention.
Figure 4:
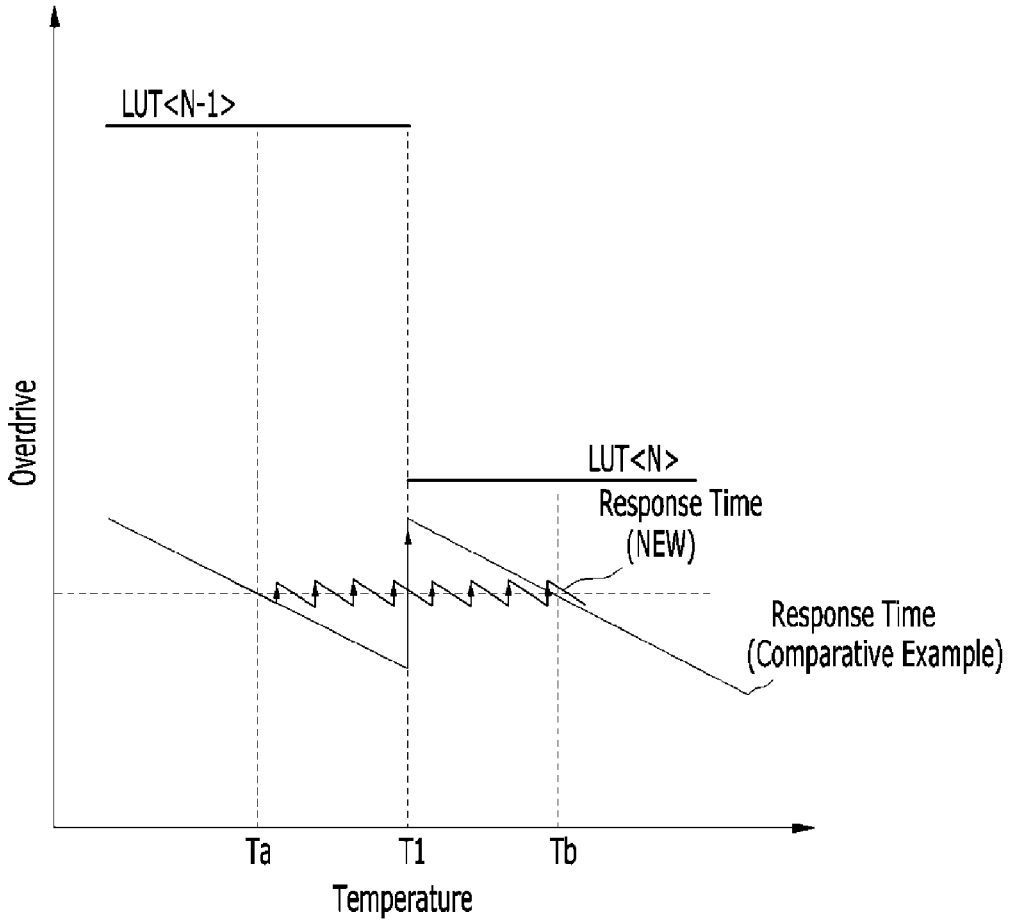
FIG. 4 is a graph showing a response characteristic of liquid crystal of a liquid crystal display of a comparative example.

FIG. 2 is a schematic diagram illustrating a liquid crystal display according to an exemplary embodiment of the present invention, FIG. 3 is a graph showing a response characteristic of a liquid crystal of a liquid crystal display according to an exemplary embodiment of the present invention, and FIG. 4 is a graph showing a response characteristic of liquid crystal of a liquid crystal display of a comparative example.

Referring to FIG. 2, the liquid crystal display may include an image signal modification unit 630, a memory 660, and a temperature sensing unit 700.

The image signal modification unit 630 modifies an input image signal, and may be included in the signal controller 600 or may be separately provided. For example, in the image signal modification unit 630, an image signal of one frame for a predetermined pixel PX ("current image signal $g_N$") may be modified based on an image signal of a previous frame for the pixel PX ("previous image signal $g_{N-1}$"). In the image signal modification unit 630, an image signal of a next frame for the pixel PX ("next image signal $g_{N+1}$") may be modified based on the current image signal $g_N$ and the previous image signal $g_{N-1}$.

The image signal modification unit 630 may modify the image signal of the current frame using predetermined arithmetic operations that are performed based on the image signal of the current frame and the image signal of the previous frame stored in the memory 600, and the image signal modification unit 630 may transmit the modified image signal to the data driver 500. The image signal of the previous frame stored in the memory 660 may be an original image signal received from an external graphic controller or an image signal modified by arithmetic operations by the image signal modification unit 630.

The image signal modification unit 630 may be operated by a DCC (dynamic capacitance compensation) method. The DCC method uses the fact that the response speed of the liquid crystal increases as the voltage exerted between both ends of a liquid crystal capacitor becomes larger so as to increase the data voltage applied to the corresponding pixel (actually, it is the difference between the data voltage and the common voltage, but it is assumed that the common voltage is 0 for convenience) than a target voltage, thereby reducing the time that the luminance display of the liquid crystal reaches a target value.

For example, when an image of a previous frame is brighter than an image of a current frame in a normally black mode liquid crystal display, that is, when the pixel voltage corresponding to the current image signal $g_N$ is larger than the pixel voltage corresponding to the previous image signal $g_{N-1}$, the pixel voltage corresponding to the current image signal $g_N$ is not applied to the pixel electrode as it is, but a pixel voltage larger than the pixel voltage corresponding to the current image signal $g_N$ is applied to the pixel electrode, which is called overshoot driving. In contrast, when the pixel voltage corresponding to the current image signal $g_N$ is smaller than the pixel voltage corresponding to the previous image signal $g_{N-1}$, the pixel voltage corresponding to the current image signal $g_N$ is not applied to the pixel electrode as it is, but a pixel voltage smaller than the pixel voltage corresponding to the current image signal $g_N$ is applied to the pixel electrode, which is called undershoot driving. The above-mentioned overshoot driving or undershoot driving is adopted to compensate for a slow switching speed of the liquid crystals. The overshoot driving or undershoot driving is one type of overdrives.

In order to perform the overshoot driving or the undershoot driving, the modified image signal based on the previous image signal $g_{N-1}$ and the current image signal $g_N$ may be stored in the memory 660 as a look-up table LUT. For example, the previous image signal $g_{N-1}$, the current image signal $g_N$, or the modified image signal may be 8 bit data having a value between 0 and 255.

As the memory 660, an external memory, eDRAM (embedded dynamic random access memory) or the like may be used. The eDRAM is a DRAM embedded in a chip that includes logic circuits and is rapidly accessible to secure a better performance.

The temperature sensing unit 700 senses the temperature of the liquid crystal display. For example, one or more temperature sensing units 700 may be disposed in the liquid crystal display and may sense the temperature in various positions in the liquid crystal display. The temperature sensing unit 700 transmits sensed temperature information to the image signal modification unit 630.

After dividing the liquid crystal display into plural regions according to the temperature distribution of the liquid crystal display, a DCC LUT among a plurality of DCC LUTs stored in the memory 660 that corresponds to the temperature of a corresponding region may be applied. This may be called a local DCC. Although not limited thereto, the liquid crystal display may be segmented in a predetermined set of plural regions with a matrix shape, each of the plural regions having one or more temperature sensors to measure the temperature of the respective region. When the local DCC is applied, the difference in response speed of the liquid crystal depending on the temperature variation of the liquid crystal display may be reduced, thereby reducing spatial variation of a crosstalk in a stereoscopic image display device. For example, when there are 8 DCC LUTs (LUT 1 to LUT 8) that are applied for each temperature interval and the liquid crystal display is divided into 12 regions (first region to twelfth region), LUT 3 that corresponds to the temperature of the first region may be applied to the first region, LUT 4 that corresponds to the temperature of the second region may be applied to the second region, and LUT 5 that corresponds to the temperature of the third region may be applied to the third region.

The temperature information may be data of 3 or more bits depending on the number of DCC LUTs maintained in the memory 660. The image signal modification unit 630 is may use a DCC LUT fixed in one temperature interval. Alternatively, the image signal modification unit 630 may use a modified DCC LUT that is calculated depending on the input temperature information by a linear interpolation method.

For example, while not limited thereto, the modified DCC LUT may be calculated by the following Equation 1.

$$\frac{T - Ta}{Tb - Ta} \times (LUT\langle Tb\rangle - LUT\langle Ta\rangle) + LUT\langle Ta\rangle \quad \text{[Equation 1]}$$

In Equation 1, T is temperature information input by the temperature sensing unit 700, Ta and Tb are a lower limit and an upper limit in a certain temperature interval, respectively, $Ta \leq T \leq Tb$ being satisfied, LUT<Ta> is an overdrive value that is applied when the temperature is Ta, and LUT<Tb> is an overdrive value that is applied when the temperature is Tb. The value calculated in Equation 1 may be represented as LUT<T>, and LUT<T> is an overdrive value that is applied when the temperature is T.

For example, referring to FIG. 3, when the temperature information is 6 bit data, the size of the temperature interval may be 3 bit data, and one temperature interval is subdivided into eight between Ta and Tb which may be calculated using Equation 1. In the temperature interval that is subdivided into eight, the look-up table of INT<1> to INT<8> may be applied, and some or all look-up tables may be calculated using Equation 1. Referring to FIG. 4, the response time of a method of a comparative example in which the look-up table is calculated by subdividing one temperature interval into eight may be more minutely changed than the response time of the comparative example in which a fixed look-up table is applied to one temperature interval, thereby improving the precision of temperature compensation 8 times.

Figure 5:
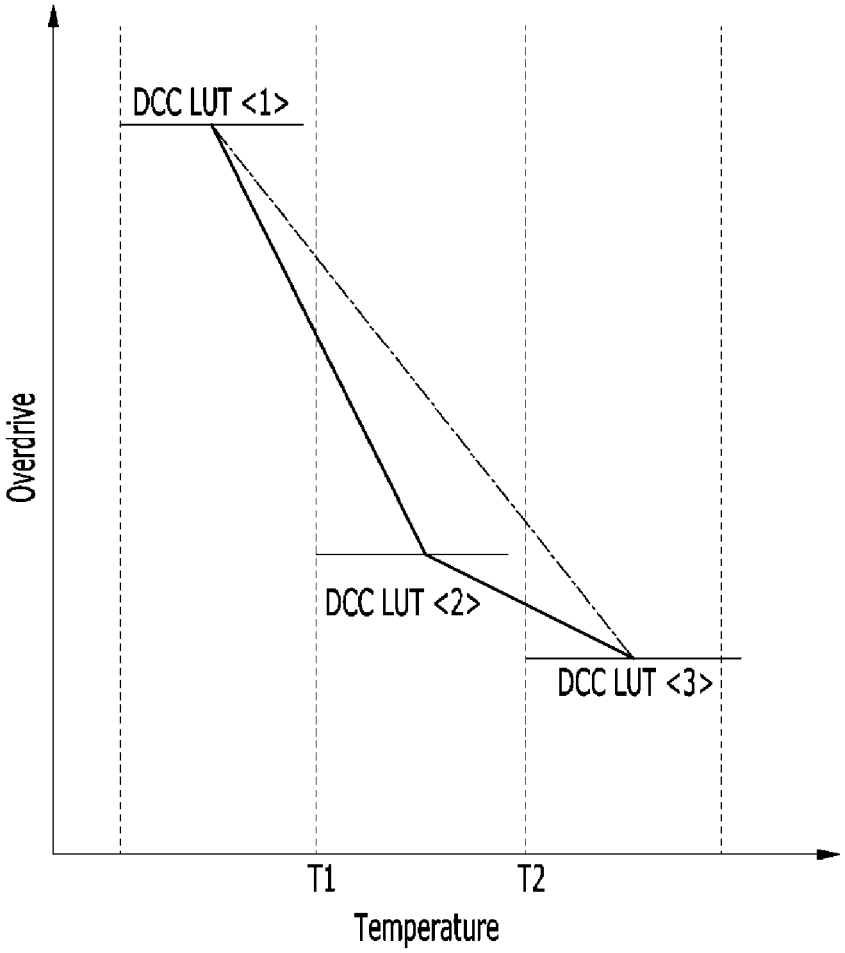
FIG. 5 is a graph showing a response characteristic of liquid crystal of a liquid crystal display according to an exemplary embodiment of the present invention.
Figure 6:
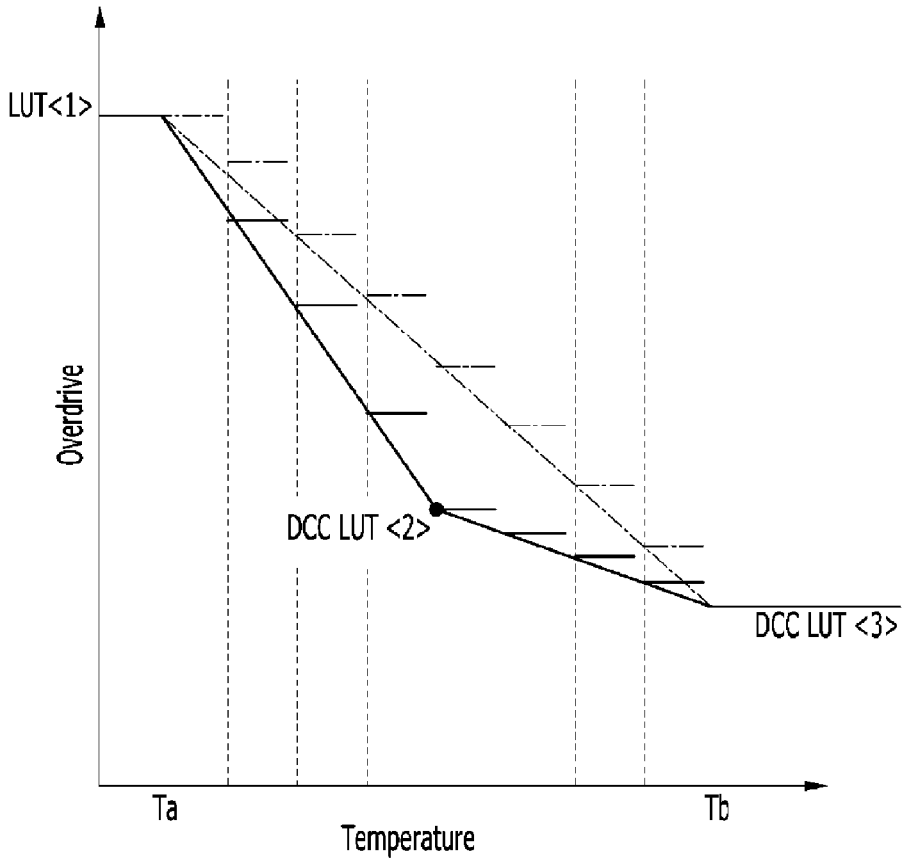
FIG. 6 is a graph showing a response characteristic of liquid crystal of a liquid crystal display according to an exemplary embodiment of the present invention.
Figure 7:
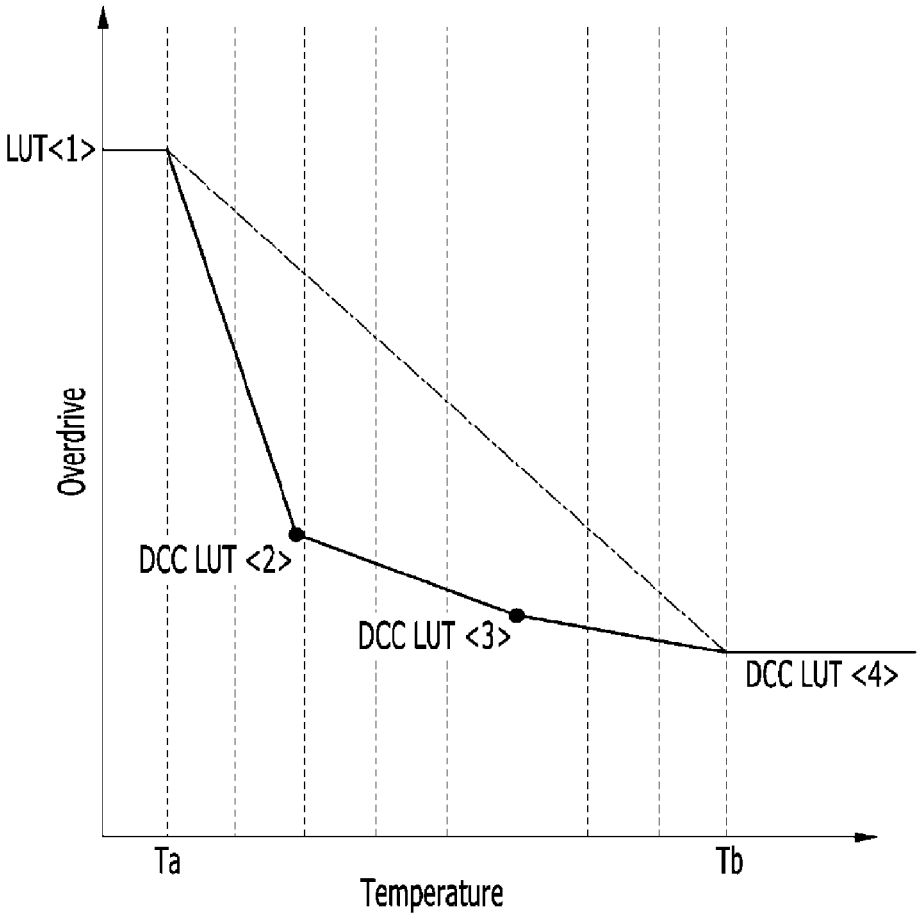
FIG. 7 is a graph showing a response characteristic of liquid crystal of a liquid crystal display according to an exemplary embodiment of the present invention.

FIG. 5 is a graph showing a response characteristic of liquid crystal of a liquid crystal display according to an exemplary embodiment of the present invention, FIG. 6 is a graph showing a response characteristic of liquid crystal of a liquid crystal display according to an exemplary embodiment of the present invention, and FIG. 7 is a graph showing a response characteristic of liquid crystal of a liquid crystal display according to an exemplary embodiment of the present invention.

Referring to FIG. 5 and FIG. 6, if the change in temperature is large at a certain region of the liquid crystal display, and a new DCC LUT is calculated to be subdivided into eight steps by the linear interpolation method, the overdrive value may be calculated like a dotted line. However, the response characteristic of the liquid crystal with respect to the temperature is nonlinear. Therefore, when the change in temperature is large, and the DCC LUT is divided into two steps and the linear interpolation method is applied in multi-steps, the overdrive value is calculated like a solid line. Among DCC LUTs that are referred to for calculation using the linear interpolation method, one or more DCC LUTs may exist. For example, when the DCC LUT is changed from LUT1 to LUT3, after dividing the temperature intervals, which are subdivided into eight, into four by four, the overdrive value between the LUT1 and the LUT2 may be calculated in four steps by the linear interpolation method, and the overdrive value between the LUT2 and the LUT3 may be calculated in four steps by the linear interpolation method. Therefore, the error caused by the nonlinearity of the response characteristic of the liquid crystal may be reduced. Referring to FIG. 7, when the DCC LUT is changed from LUT1 to LUT4, after dividing the temperature intervals, which are subdivided into eight, into two, three, and three, respectively, the overdrive value between the LUT1 and the LUT2 may be calculated in two steps by the linear interpolation method, the overdrive value between the LUT2 and the LUT3 may be calculated in three steps by the linear interpolation method, and the overdrive value between the LUT3 and the LUT4 may be calculated in three steps by the linear interpolation method. It may be determined in advance whether the linear interpolation method is applied in multi steps since the information regarding a change in the DCC LUT in a predetermined region of the liquid crystal display may be stored in the memory 600.

Figure 8A:
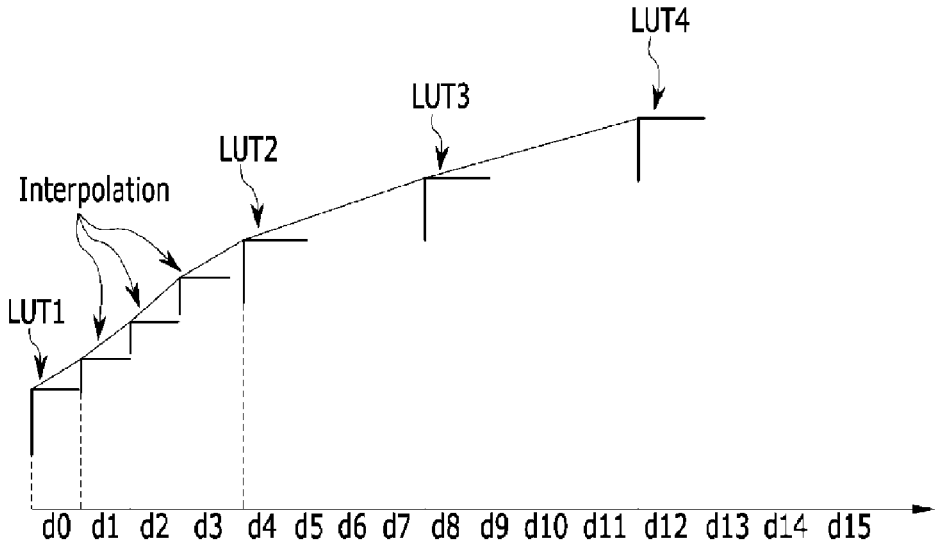
FIG. 8A and FIG. 8B are diagrams showing a relationship between a temperature and a look-up table.
Figure 8B:
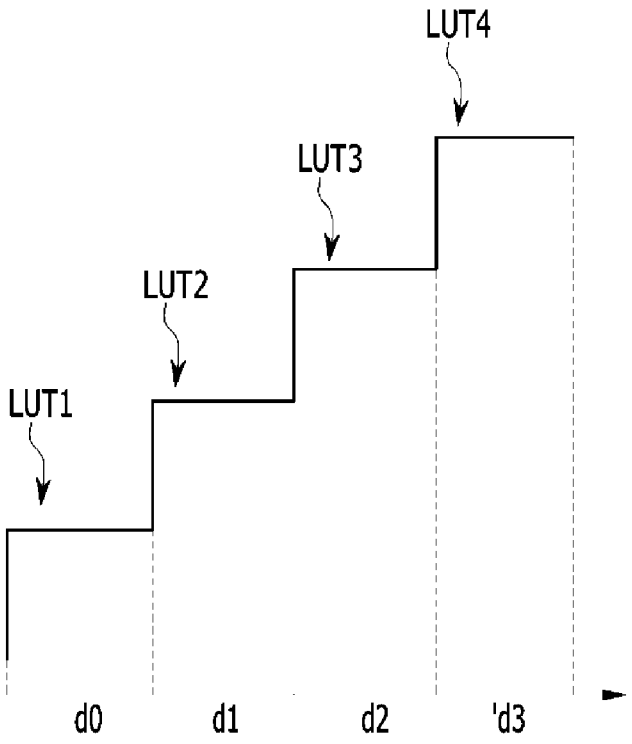

FIG. 8A and FIG. 8B are diagrams showing a relationship between a temperature and a look-up table. Even though the DCC LUT is calculated by the linear interpolation method, the DCC LUT is calculated once only when the DCC LUT value is loaded. Therefore, the increase in the amount of hardware is insignificant as compared with the local LUT of the comparative example. The liquid crystal display according to an exemplary embodiment of the present invention does not use the LUT1 to LUT 4 that are fixed in accordance with 2 bit temperature information as shown in FIG. 8B, but uses a new LUT that is calculated in accordance with 3 bit or more temperature information by the linear interpolation method as shown in FIG. 8A. Referring to FIG. 8A and FIG. 8B, the number of look-up tables that are simultaneously used is four, and the increase in the hardware such as a memory is insignificant.

When the temperature compensation DDC is performed for every region in the local DDC, the liquid crystal display according to the exemplary embodiment of the present invention may improve the inversion of the liquid crystal response time occurring when the DCC LUT is changed due to the change in the temperature information input from the temperature sensing unit 700.

The liquid crystal display according to the exemplary embodiment of the present invention may apply the linear interpolation method in two or more steps in a region where the sharp temperature change occurs, thereby reducing the error in temperature compensation due to the nonlinearity of the response characteristic of the liquid crystal.

An exemplary embodiment of the present invention may improve the temperature compensation effects with DCC (dynamic capacitance compensation) method and reduce the crosstalk in a stereoscopic image display device.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a pixel;

a memory configured to store a plurality of look-up tables;

an image signal modification unit configured to obtain a modified look-up table based on an interpolation between a first look-up table and a second look-up table among the plurality of look-up tables and modify an input image signal based on the modified look-up table to generate a modified image signal; and a data driver configured to convert the modified image signal generated by the image signal modification unit into a data voltage and to supply the data voltage to the pixel, wherein:

the liquid crystal display comprises a plurality of regions, the liquid crystal display is configured to maintain temperature information of the plurality of regions, and the image signal modification unit is configured to select, for the region comprising the pixel, the first and second look-up tables according to the temperature information of the region;

the first and second look-up tables comprise overdrive values to modify the image signal at upper and lower temperature limits, respectively, of a determined temperature interval comprising the temperature information of the region; and the image signal modification unit is configured to:

modify a current image signal based on a previous image signal; and modify a next image signal based on the previous image signal and the current image signal.

2. The liquid crystal display of claim 1, wherein:

the image signal modification unit is configured to obtain the modified look-up table by a linear interpolation method.

3. The liquid crystal display of claim 2, wherein:

the modified look-up table is different from the plurality of look-up tables.

4. The liquid crystal display of claim 3, wherein:

the modified look-up table is calculated using Equation 1:

$$\frac{T - Ta}{Tb - Ta} \times (LUT\langle Tb\rangle - LUT\langle Ta\rangle) + LUT\langle Ta\rangle \quad \text{[Equation 1]}$$

wherein, T is the temperature information, Ta and Tb are the lower limit and the upper limit of the determined temperature interval, respectively, Ta≤T≤Tb being satisfied, LUT<Ta> is an overdrive value at a temperature Ta, and LUT<Tb> is an overdrive value at a temperature Tb.

5. The liquid crystal display of claim 4, wherein:

the plurality of look-up tables comprise voltage values corresponding to the modified image signal based on a previous image signal and a current image signal.

6. The liquid crystal display of claim 1, wherein:

the plurality of look-up tables comprise one or more third look-up tables, a second temperature corresponding to the second look-up table is higher than a first temperature corresponding to the first look-up table, and temperatures corresponding to the one or more third look-tables are higher than the first temperature and lower than the second temperature.

7. The liquid crystal display of claim 6, wherein:

the image signal modification unit is configured to apply a linear interpolation method based on the first look-up table and the one or more third look-up tables, and apply another linear interpolation method based on the one or more third look-up tables and the second look-up table.

8. The liquid crystal display of claim 7, wherein:

the modified look-up table is different from the plurality of look-up tables.

9. The liquid crystal display of claim 8, wherein:

the modified look-up table is calculated using Equation 1:

$$\frac{T - Ta}{Tb - Ta} \times (LUT\langle Tb\rangle - LUT\langle Ta\rangle) + LUT\langle Ta\rangle \quad \text{[Equation 1]}$$

wherein, T is the temperature information, Ta and Tb are a lower limit and an upper limit in a predetermined temperature interval, respectively, Ta≤T≤Tb being satisfied, LUT<Ta> is an overdrive value at a temperature Ta, and LUT<Tb> is an overdrive value at a temperature Tb.

10. The liquid crystal display of claim 9, wherein:

the plurality of look-up tables comprise values corresponding to the modified image signal based on a previous image signal and a current image signal.

11. The liquid crystal display of claim 1, wherein:

the temperature information is 3 bit or more data.

12. The liquid crystal display of claim 11, further comprising:

a temperature sensing unit configured to sense the temperature information of the region and to output the temperature information.

13. The liquid crystal display of claim 12, wherein:

the modified look-up table is different from the plurality of look-up tables.

14. The liquid crystal display of claim 13, wherein:

the modified look-up table is calculated using Equation 1:

$$\frac{T - Ta}{Tb - Ta} \times (LUT\langle Tb\rangle - LUT\langle Ta\rangle) + LUT\langle Ta\rangle \quad \text{[Equation 1]}$$

wherein, T is the temperature information, Ta and Tb are the lower limit and the upper limit of the determined temperature interval, respectively, Ta≤T≤Tb being satisfied, LUT<Ta> is an overdrive value at a temperature Ta, and LUT<Tb> is an overdrive value at a temperature Tb.

15. The liquid crystal display of claim 14, wherein:

the plurality of look-up tables comprise voltage values corresponding to the modified image signal based on a previous image signal and a current image signal.

16. The liquid crystal display of claim 1, wherein:

the overdrive is overshoot driving or undershoot driving.

17. A method of displaying an image on a liquid crystal display, the liquid crystal display comprising a plurality of regions, the method comprising:

storing a plurality of look-up tables;

obtaining a modified look-up table based on an interpolation between a first look-up table and a second look-up table among the plurality of look-up tables;

modifying an input image signal based on the modified look-up table and temperature information of a region among the plurality of regions to generate a modified image signal; and converting the modified image signal into a data voltage and supplying the data voltage to a pixel of the liquid crystal display in the region, wherein:

the first and second look-up tables are selected according to the temperature information of the region;

the first and second look-up tables comprise overdrive values to modify the image signal at upper and lower temperature limits, respectively, of a determined temperature interval comprising the temperature information of the region; and the modifying an input image signal comprises:

modifying a current image signal based on a previous image signal; and modifying a next image signal based on the previous image signal and the current image signal.

18. The method of claim 17, wherein:

obtaining the modified look-up table comprises using a linear interpolation method.

* * * * *